US010165816B2

(12) United States Patent
Cho

(10) Patent No.: US 10,165,816 B2
(45) Date of Patent: Jan. 1, 2019

(54) ADORNING APPARATUS AND HEADWEAR USING THE SAME

(71) Applicant: Yupoong, Inc., Seoul (KR)

(72) Inventor: Byoung-Woo Cho, Seoul (KR)

(73) Assignee: YUPOONG, INC., Seoul (KR)

( * ) Notice: Subject to any disclaimer, the term of this patent is extended or adjusted under 35 U.S.C. 154(b) by 0 days.

(21) Appl. No.: 13/968,999

(22) Filed: Aug. 16, 2013

(65) Prior Publication Data

US 2014/0053319 A1 Feb. 27, 2014

(30) Foreign Application Priority Data

Aug. 24, 2012 (KR) ..... 10-2012-0092971

(51) Int. Cl.
*A42B 1/24* (2006.01)

(52) U.S. Cl.
CPC ..... *A42B 1/248* (2013.01)

(58) Field of Classification Search
CPC .. A42B 1/22; A42B 1/24; A42B 1/004; A42B 1/248; A42B 1/245; A42B 1/18; A42B 1/006; A42B 1/247; A42B 1/241; A42B 1/244; A42B 1/242; A42B 1/041; A42B 1/067; A42B 1/201; A42B 1/203; A42B 3/003; A42B 3/04; A42B 3/046; A42B 1/062; A42B 3/00; A42B 1/008; A42B 1/064; A42B 1/12; A42B 1/225; A42B 3/0406; A42B 3/062; A42B 7/00; A42B 1/069; A42B 1/16
USPC ... 2/209.13, 10, 195.2, 200.1, 425, 171, 181
See application file for complete search history.

(56) References Cited

U.S. PATENT DOCUMENTS

| | | | | |
|---|---|---|---|---|
| 5,287,559 | A | 2/1994 | Christiansen et al. | |
| 5,546,605 | A | 8/1996 | Mallardi | |
| 5,652,959 | A * | 8/1997 | Proctor | A42B 1/004 132/319 |
| 5,901,381 | A * | 5/1999 | Nelson | 2/209.13 |
| 5,909,803 | A * | 6/1999 | Clark | A42B 1/22 2/195.2 |
| 6,829,785 | B2 * | 12/2004 | Park | 2/195.4 |
| 6,870,796 | B2 * | 3/2005 | Elling | 368/10 |
| 6,895,602 | B2 * | 5/2005 | Schlapkohl | 2/209.13 |
| 6,986,166 | B2 | 1/2006 | Cho | |
| 8,434,165 | B2 | 5/2013 | Cho | |

(Continued)

FOREIGN PATENT DOCUMENTS

| | | |
|---|---|---|
| KR | 10-2001-0076817 A | 8/2001 |
| KR | 20-0433381 | 12/2006 |

*Primary Examiner* — Megan Lynch
*Assistant Examiner* — Catherine M Ferreira
(74) *Attorney, Agent, or Firm* — Lex IP Meister, PLLC

(57) ABSTRACT

An apparatus for adorning a size control portion, formed in at least one of lower lateral sides of an opening portion of headwear according to an exemplary embodiment of the present invention includes an adorning portion having at least one face that is 3-dimensionally adorned, a support portion connected to the adorning portion to support the adorning portion, and a detachable coupling portion formed in a part of the support portion and detachably coupled to the size control portion. According to the present invention, an apparatus for freely and variously adorning a size control portion provided in a lower edge portion of a head receiving portion of headwear at low cost, and the adorning apparatus can be used in headwear.

6 Claims, 6 Drawing Sheets

(56) References Cited

U.S. PATENT DOCUMENTS

| | | | | |
|---|---|---|---|---|
| 8,763,163 | B1 * | 7/2014 | Johns | 2/200.1 |
| 2002/0152539 | A1 * | 10/2002 | Christian | 2/209.13 |
| 2007/0022516 | A1 | 2/2007 | Wuensche et al. | |
| 2008/0263839 | A1 * | 10/2008 | Stillwell | 24/713.6 |
| 2011/0219522 | A1 * | 9/2011 | Petitt | 2/422 |
| 2013/0205473 | A1 * | 8/2013 | Kronenberger | 2/209.13 |

* cited by examiner

ADORNING APPARATUS AND HEADWEAR USING THE SAME

CROSS-REFERENCE TO RELATED APPLICATIONS

This application claims priority to and the benefit of Korean Patent Application No. 10-2012-0092971 filed in the Korean Intellectual Property Office on Aug. 24, 2012, the entire contents of which are incorporated herein by reference.

FIELD OF THE INVENTION

The present invention relates to an apparatus for adorning a size control portion of headwear, and headwear using the same. More particularly, the present invention relates to an apparatus for adorning a size control portion of headwear, and headwear using the same. The apparatus can variously adorn a size control portion provided in a lower edge of a head receiving portion of headwear at low cost.

BACKGROUND OF THE INVENTION

In general, as shown in FIGS. 1A and 1B, a size-controllable headwear that can be commonly used without regard to the size of the head of a wearer includes a dome-shaped opening 1*a* in a back portion of headwear 1, and size controllers 110 provided in lower lateral sides of the opening portion 1*a* for controlling the size of the headwear 1 in a head circumferential direction.

The size controllers 110 are respectively formed of a male size control portion 111 including a plurality of coupling protrusions 111*a* respectively formed at a constant distance from each other, and a female size control portion 113 including a plurality of coupling holes 113*a* that respectively correspond to the plurality of coupling protrusions 111*a*. Such a structure can be simply manufactured and size can be easily controlled, and the fixed size is not easily loosened. The headwear having such a size controller 110 is widely used, particularly, by long-haired wearer because tied hair can be pulled out through the opening portion 1*a*.

Recently, a method for adorning the size controller 110 has been researched and developed in order to expand such a usage of the headwear 1.

However, a conventional method for adorning the size controller 110 requires an injection molding method to add an adorning element to the female and male size control portions 111 and 113, but design for each size controller 110 requires expensive injection molding, and an image of the adorning apparatus and the size control portions have limits in expression because they should have the same color and material. In addition, the adorning apparatus has a size limit, and the adorning apparatus cannot be 3-dimensionally expressed due to a limit of the injection molding. For these reasons, the conventional injection molding method for adorning the size controller 110 cannot be substantially used.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an apparatus for adorning a size control portion that can be made of various materials in various colors and sizes at low cost and can provide 3-dimensional expression, and headwear using the same.

An apparatus for adorning a size control portion, formed in at least one of lower both side portions of an opening portion of headwear according to an exemplary embodiment of the present invention includes an adorning portion having at least one surface that is 3-dimensionally adorned, a support portion connected to the adorning portion to support the adorning portion, and a detachable coupling portion formed in a part of the support portion and detachably coupled to the size control portion.

The apparatus for adorning the size control portion formed in at least one of the lower both side portions of the opening portion of the headwear includes a support portion thin enough to not significantly protrude when being coupled to the size control portion, a detachable coupling portion formed in the support portion and detachably coupled to the size control portion, and an adorning portion connected to the support portion and having one face that is 3-dimensionally adorned.

In headwear that can use the apparatus for adorning the size control portion according to an exemplary embodiment of the present invention, the size control portion may include a recess portion formed in a main body extended in a head circumferential direction corresponding to the thickness and the size of the support portion of the apparatus for adorning the size control portion.

In headwear that can use the apparatus for adorning the size control portion according to an exemplary embodiment of the present invention, the size control portion of the headwear may include a coupling protrusion integrally formed in a main body extended in a head circumferential direction, and the height of the coupling protrusion may be larger than the sum of the thickness of the size control portion and the thickness of the support portion of the apparatus for adorning the size control portion.

In the size control portion of the headwear, the size control portion may include a wing portion having a plurality of auxiliary coupling portions along a length direction in a main body extended in a head circumferential direction.

According to the exemplary embodiments of the present invention, a main body portion of an adorning apparatus fastened with a size control portion is designed to be very thin so that the size control portion can be freely fastened to and detached from the size control portion of the headwear, and the size control portion can be formed in various shapes with various colors and can be 3-dimensionally expressed.

A conventional injection molding method for adorning a plastic size control portion has a limit in various expression, but according to the exemplary embodiments of the present invention, the adorning apparatus can be detachably fitted into the plastic size control portion so that the size control portion can be formed in various shapes with various colors corresponding to various user's demands, and an one face molding method can be adopted by adopting an inexpensive open molding method. In addition, small-quantity production is available, and the adorning apparatus can be used in various size control portions such as a plastic, hook, or loop type.

DETAILED DESCRIPTION OF THE PREFERRED EMBODIMENTS

Figure 1A:
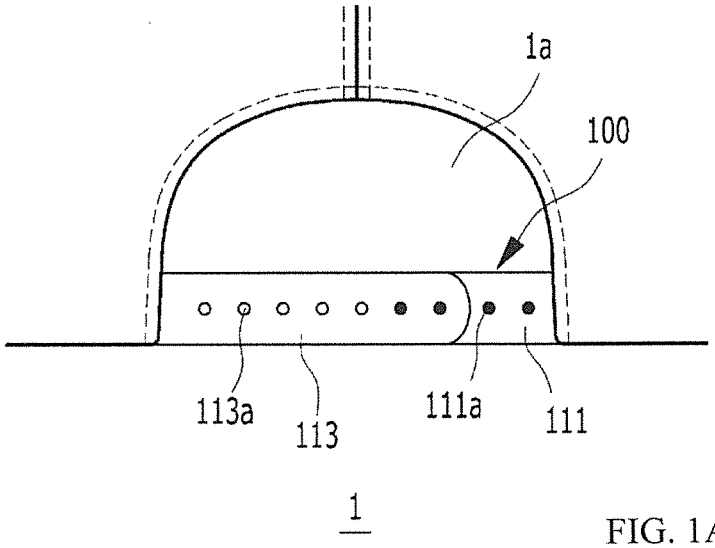
FIG. 1A is a schematic view for description of a concept of headwear using a general size controller shown with a male size control portion and a female size control portion affixed to one another in a first position.
Figure 1B:
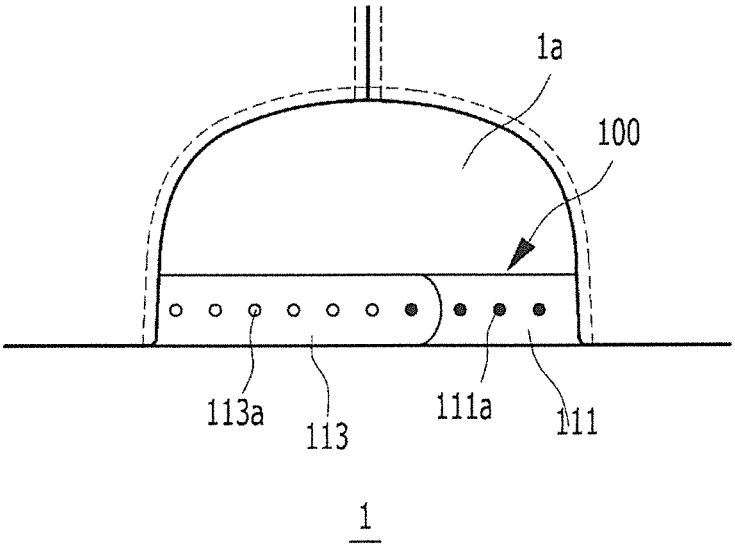
FIG. 1B is a schematic view for description of a concept of headwear using a general size controller shown with a male size control portion and a female size control portion affixed to one another in a second position.

Hereinafter, exemplary embodiments of the present invention will be described in detail with reference to the attached drawings.

Like reference numerals designate like elements throughout the specification.

Further, detailed descriptions of well-known functions and structures incorporated herein may be omitted to avoid obscuring the subject matter of the present invention.

In this specification, headwear includes various headwear forms such as a hat and a visor as well as baseball headwear, and a second size adjustment unit may use various materials such as conventional plastic, cloth, and leather as well as various size adjustment members such as a female and male coupling type, a string, a buckle, and a band form.

Referring to FIG. 2A to FIG. 5, an adorning apparatus for a size controller according to an exemplary embodiment of the present invention and an exemplary variation thereof, and headwear using the same, will be described.

Figure 2A:
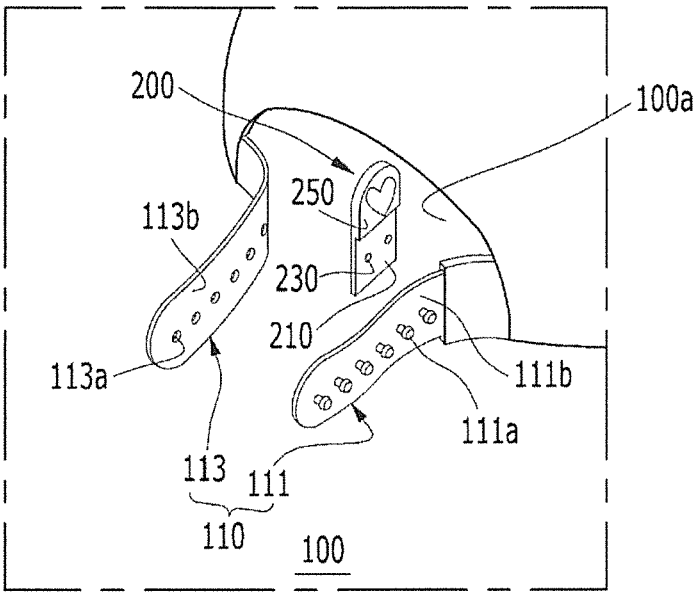
FIG. 2A is a partial perspective back view of a size controller adorning apparatus and headwear using the same according to an exemplary embodiment of the present invention.
Figure 2B:
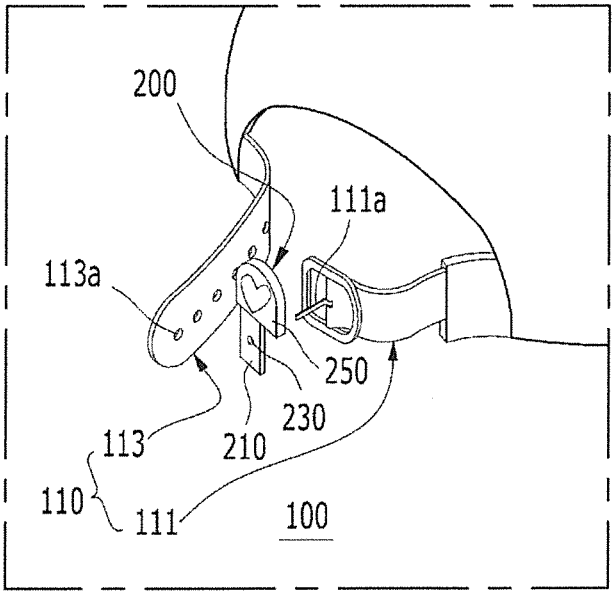
FIG. 2B is a partial perspective back view of a size controller adorning apparatus according to an exemplary variation of the present invention, and headwear using the same.
Figure 3A:
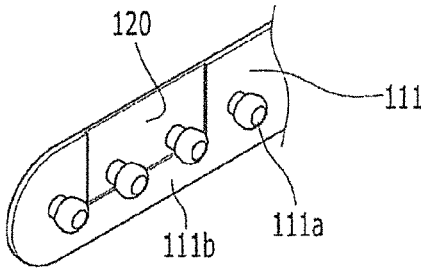
FIG. 3A is a schematic view for description of headwear using the size controller defining a recess portion for receiving an adorning apparatus according to the exemplary embodiment of the present invention.
Figure 3B:
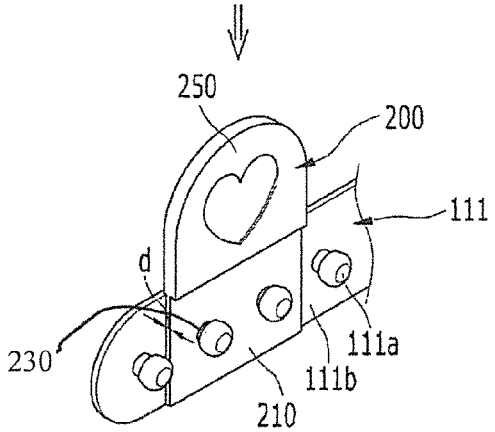
FIG. 3B is a schematic view for description of headwear using the size controller shown receiving an adorning apparatus.
Figure 3C:
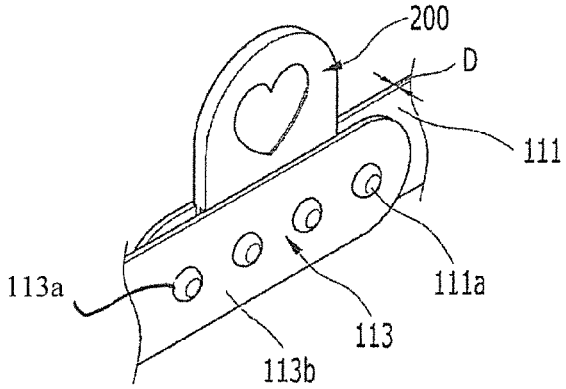
FIG. 3C is a schematic view for description of headwear using the size controller wherein the adorning apparatus of FIG. 3B is shown between a male size control portion and a female size control portion.
Figure 4:
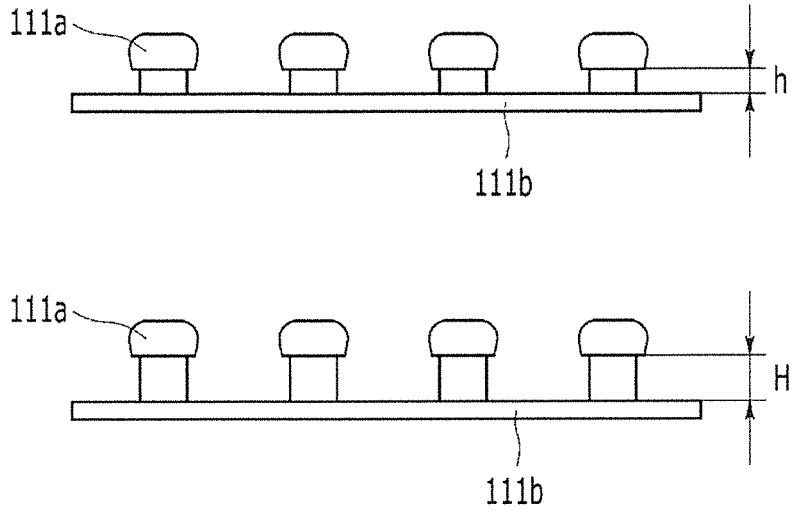
FIG. 4 is a schematic view of headwear using the size controller adorning apparatus according to the exemplary variation of the present invention.
Figure 5:
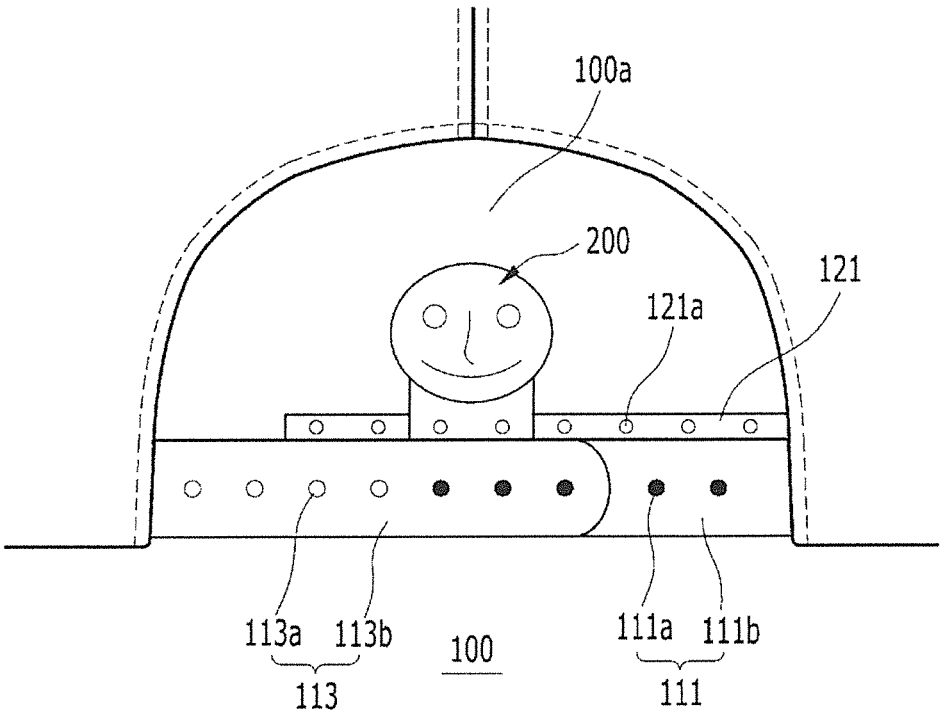
FIG. 5 is a schematic view of headwear using a size controller adorning apparatus according to another exemplary variation of the present invention.

FIG. 2A is a partial perspective back view of a size controller adorning apparatus and headwear using the same, FIG. 2B is a partial perspective back view of a size controller adorning apparatus and headwear using the same according to an exemplary variation of the present invention, FIGS. 3A-3C are schematic views of headwear using a size controller adorning apparatus according to the exemplary embodiment of the present invention, FIG. 4 is a schematic view of headwear using the size controller adorning apparatus according to the exemplary variation of the present invention, and FIG. 5 is a schematic view of headwear using a size controller adorning apparatus according to another exemplary variation of the present invention.

Referring to FIG. 2A, according to an exemplary embodiment of the present invention, a dome-shaped opening 100*a* is formed in a back side of headwear 100, and the size controller 110 may be provided between lower lateral ends of the opening 100*a* to control a head circumferential direction length.

In the headwear 100 according to the exemplary embodiment of the present invention, the size controller 110 may include size control portions 111 and 113 coupled to at least one of the lower lateral ends of the opening 100*a*.

The size control portions 111 and 113 may have a pair of female or male size control portions respective formed in flexible flat-shaped main bodies 111*b* and 113*b* where coupling protrusions 111*a* and coupling holes 113*a* are respectively formed.

As shown in FIG. 2A, an adorning apparatus 200 for adorning the size portion portions 111 and 113 may be provided in the size control portions 111 and 113.

The adorning apparatus 200 may include a thin plate-type support portion 210, a detachable coupling portion 230, and an adorning portion 250. The support portion 210 is formed to be thin so as not to be significantly protruded when being coupled to the size control portions 111 and 113, and the detachable coupling portion 230 is detachably coupled to the size control portions 111 and 113. The adorning portion 250 is connected to the thin plate-type support 210, and at least one face of the adorning portion 250, preferably, the one face of the adorning portion 250 may be 3-dimensionally adorned.

The detachable coupling portion 230 may be formed in the shape of a hole so as to be coupled to the coupling protrusion 111*a* of the male size control portion 111, and at least one face of the adorning portion 250 may be injection-molded to have various 3D patterns through open molding.

The thin plate-type support portion 210 and the adorning portion 250 may be integrally molded, or they may be separately formed and then coupled with each other through various methods.

As shown in FIG. 2B, the size controller 110 may be formed of the female size control portion 113 that is formed in one face of the opening 100*a* and has the coupling holes 113*a* and the male size controller 111 formed as a buckle hook in the other side of the opening 100*a*.

In this case, the adorning apparatus 200 may be provided with a single hole-type coupling portion 230 formed in the thin plate-type support portion 210 to correspond to the single buckle hook. Here, the hole-type coupling portion 230 is reversibly attachable to one coupling protrusion 111*a* of the male size control portion 111, and at least one face of the adorning portion 250 may be 3-dimensionally shaped.

As shown in FIGS. 3A-3C, a recess portion 120 may be provided in at least one of the main bodies 111*b* and 113*b* of the size control portions 111 and 113 to receive the thickness and the size of the thin plate-type support portion 210 of the adorning apparatus 200.

As described, since the recess portion 120 is provided in at least one of the size control portions 111 and 113, the thin plate-type support portion 210 is mounted to the recess portion 120 and thus provided in the same plane even though the hole-shaped coupling portion 230 of the adorning apparatus 200 is coupled to the coupling protrusion 111*a* of the size control portion 111, and although the female size control portion 113 having the coupling holes 113*a* formed therein is coupled on the thin plate-type support portion 210 that is mounted to the recess portion 120, the adorning portion 250 can adorn the size control portions 111 and 113 by exposing the adorning portion 250 without interfering with the coupling of the female or male size control portions 111 and 113 and without exposing the thin plate-type support portion 210.

In addition, as shown in FIG. 4, the coupling protrusions 111*a* are integrally formed in the main body 111*b* that is extended in the head circumferential direction of the male size control portion 111 among the size control portions 111 and 113, and a height h of each coupling protrusion 111*a* is formed as a height H that is greater than the sum of a thickness D of the size control portion 111 and a thickness d of the thin plate-type support portion 210 of the adorning apparatus 200, and thus the size control portions 111 and 113 can be adorned by exposing the adorning portion 250 without interfering with the coupling of the female and male size control portions 111 and 113 and without exposing the thin plate-type support portion 210 even through the hole-type coupling portion 230 of the adorning apparatus 200 is coupled to the coupling protrusion 111*a* and then the coupling protrusion 111*a* is coupled to the coupling hole 113*a* of the female size control portion 113.

In addition, as shown in FIG. 5, a wing portion 121 having a plurality of auxiliary coupling portion 121*a* formed along a length direction of the main bodies 111*b* and 113*b* of the size control portions 111 and 113 may further be provided.

The auxiliary coupling portion 121*a* may be a plurality of protrusions respectively distanced from each other, or may be a plurality of holes, a plurality of embossed hooks, and a plurality of hooks sewing-coupled in a fabric cloth, and this will be described later with reference to FIG. 7A to FIG. 7C.

As the wing portion 121 having the auxiliary coupling portions 121*a* are further provided, the size control portions 111 and 113 can be adorned by coupling the adorning apparatus 200 without interfering with the coupling of the female or male size control portions 111 and 113.

A size control portion adorning apparatus according to another exemplary embodiment of the present invention, and headwear using the same, will now be described with reference to FIG. 6 to FIG. 7C.

Figure 6:
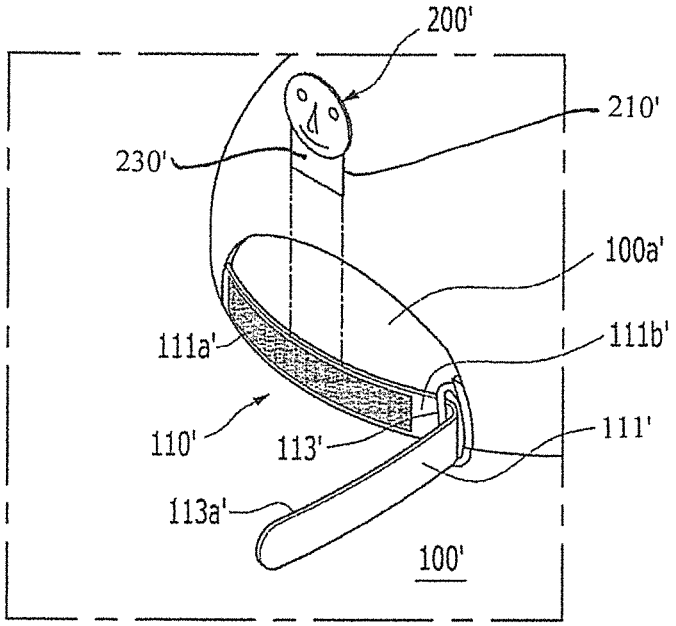
FIG. 6 is a partial perspective back view of a size controller adorning apparatus according to another exemplary embodiment of the present invention, and headwear using the same.
Figure 7A:
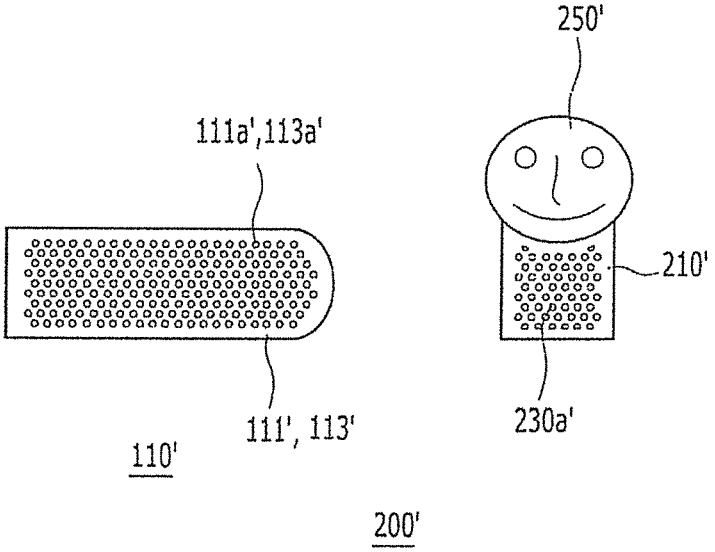
FIG. 7A is a schematic view of headwear using the size controller adorning apparatus according to the other exemplary embodiment of the present invention.
Figure 7B:
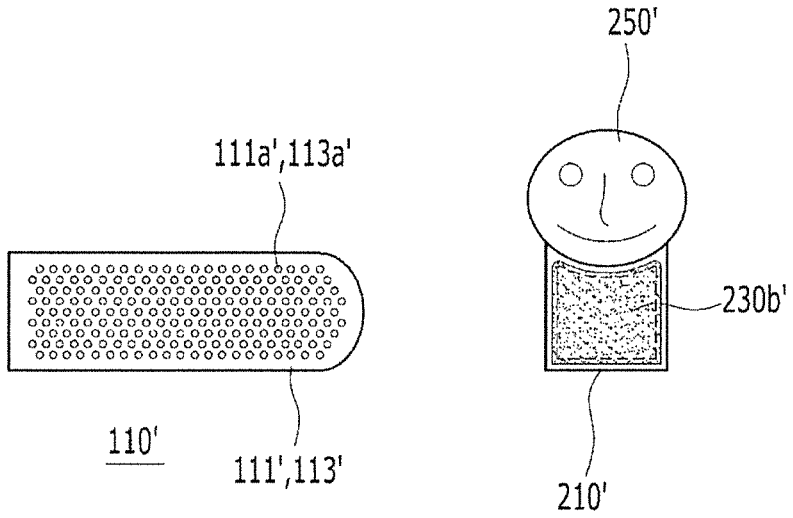
FIG. 7B is a schematic view of headwear using a size controller adorning apparatus according to an exemplary variation of the present invention.
Figure 7C:
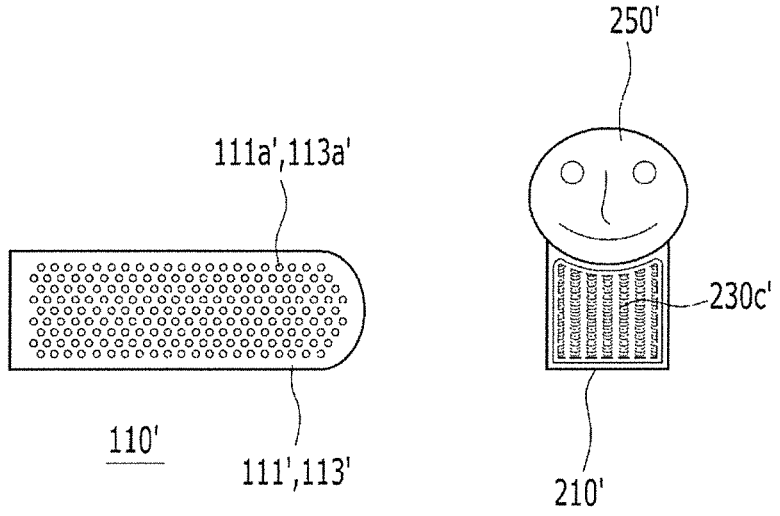
FIG. 7C is a schematic view of headwear using a size controller adorning apparatus according to another exemplary variation of the present invention.

FIG. 6 is a partial perspective back view of a size control portion adorning apparatus and headwear using the same according to another exemplary embodiment of the present invention, FIG. 7A is a schematic view of headwear using the size controller adorning apparatus according to the other exemplary embodiment of the present invention, FIG. 7B is a schematic view of headwear using a size controller adorning apparatus according to an exemplary variation of the present invention, and FIG. 7C is a schematic view of headwear using a size controller adorning apparatus according to another exemplary variation of the present invention.

As shown in FIG. 6, in headwear 100' according to the other exemplary embodiment of the present invention, a size controller 110' may include a size control portion 111' formed of Velcro-type female or male coupling portions 111*a*' and 113*a*' formed in single band-type main body 111*b*' and a ring 113'. The size control portion 111' is provided in one side portion of an opening portion 100*a*' and the ring 113' is provided in the other side portion of the opening portion 100*a*'.

Meanwhile, the size controller 110' may be formed of a single band-type size control portion 111' provided in one side portion of the opening 100*a*' and a buckle provided in the other side portion of the opening 100*a'*.

As shown in FIG. 6 and FIG. 7A, an adorning apparatus 200' may be provided in the size control portions 111' and 113' to adorn the size control portions 111' and 113'.

The adorning apparatus 200' for adorning the size control portion includes a thin plate-type support portion 210', a female or male coupling portion 230', and an adorning portion 250'. The support portion 210' faces the size control portions 111' and 113' and is formed thin so as to not excessively protrude when the support portion 210' is coupled with the size control portions 111' and 113', and the female or male coupling portion 230' is formed wide in the support portion 210' to couple the support portion 210' to the female and male coupling portions 111*a*' and 113*a*' of the size control portions 111' and 113'. Various 3D patterns can be molded in at least one face of the adorning portion 250' by an open molding process.

The thin plate-type support portion 210' and the adorning portion 250' may be integrally molded, or may be individually manufactured and then coupled to each other through various methods.

As shown in FIG. 7A, in headwear 100' according to the current exemplary embodiment of the present invention, when the female or male coupling portions 111*a*' and 113*a*' of the size control portions 111' and 113' are formed as hooks by embossing, the female and male coupling portion 230*a*' may be formed as hooks by embossing in the thin plate-type support portion 210' corresponding to the female or male coupling portions 111*a*' and 113*a*'.

As shown in FIG. 7B, in headwear 100' according to another exemplary embodiment of the present invention, the female or male coupling portions 111*a*' and 113*a*' of the size control portions 111' and 113' may be sew-coupled in a fabric cloth form having a plurality of loops, and a plurality of hooks 230*b*' may be formed by embossing in the female or male coupling portion 230' formed in the thin plate-type support portion 210' corresponding to the female or male coupling portions 111*a*' and 113*a*'.

As shown in FIG. 7C, in headwear 100' according to the current exemplary embodiment of the present invention, the female or male coupling portions 111*a*' and 113*a*' of the size control portions 111' and 113' may be sew-coupled in a fabric cloth form having a plurality of loops 111*a*', and a plurality of hooks 230*c*' may be sew-coupled in a fabric cloth form in the female or male coupling portion 230' formed in the thin plate-type support portion 210'.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

100, 100': headwear
110, 110': size controller
111, 113, 111', 113': female or male size control portion
111*a*, 113*a*, 111*a*', 113*a*': female or male coupling portion
121: a wing portion

200, 200': size control portion adorning apparatus
210, 210': thin plate-type support portion
230, 230': coupling portion
250, 250': adorning portion Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A headwear and adorning apparatus assembly, comprising:

a size controller having a male size control portion having a base end affixed to the headwear and a female size control portion having a base end affixed to the headwear, the male size control portion having a distal end, the female size control portion having a distal end, the distal ends affixing to one another, the distal ends defining an overlapping portion for selectively adjusting a head size of the headwear;

an adorning apparatus having an adorning portion and a support portion to support the adorning portion, the adorning apparatus being attachable to and detachable from the size controller, wherein:

the size controller spans across an opening portion defined by the headwear, the male size control portion has a coupling protrusion and the female size portion has a coupling hole, the adorning portion has a front surface and a back surface, the front surface being three-dimensionally adorned and the back surface being flat, the support portion extends away in a vertical direction from the adorning portion for a distance that is equal to a width of the size controller, the support portion being interposed between the male size control portion and the female size control portion and disposed within the overlapping portion, the support portion is rectangular and is thinner than the adorning portion, the support portion has a detachable coupling portion for detachably being coupled to the male size control portion, a recess portion is formed in the size controller, and extended in a head circumferential direction corresponding to a thickness and a width of the support portion to receive the support portion, the recess portion is located within a space defined by the opening portion, and a height of the coupling protrusion is greater than a sum of a thickness of the size controller and the thickness of the support portion.

2. The headwear and adorning apparatus assembly of claim 1, wherein:

the detachable coupling portion of the support portion receives the coupling protrusion for securing the support portion between the male size control portion and the female size control portion , and the detachable coupling portion is located within a space defined by the opening portion of the headwear for displaying the adorning apparatus.

3. The headwear and adorning apparatus assembly of claim 1, wherein the detachable coupling portion has a hole corresponding to the coupling protrusion of the male size control portion.

4. The headwear and adorning apparatus assembly of claim 1, wherein the male size control portion further comprises a wing portion having a plurality of auxiliary coupling portions along a length direction of a section of the male size control portion extended in the head circumferential direction.

5. The headwear and adorning apparatus assembly of claim 4, wherein the plurality of auxiliary coupling portions are a plurality of protrusions.

6. The headwear and adorning apparatus assembly of claim 5, wherein the support portion comprises a plurality of holes corresponding to the plurality of auxiliary coupling portions.

* * * * *